United States Patent [19]

Totino

[11] 4,216,734

[45] Aug. 12, 1980

[54] SEWING MACHINE WITH UNIVERSAL UPPER FEED

[75] Inventor: Peter J. Totino, N. Bergen, N.J.

[73] Assignee: The Singer Company, Stamford, Conn.

[21] Appl. No.: 24,226

[22] Filed: Mar. 26, 1979

[51] Int. Cl.[2] ..... D05B 27/04

[52] U.S. Cl. ..... 112/320

[58] Field of Search ..... 112/320, 311, 309, 312, 112/324, 314, 121.12, 47

[56] References Cited

U.S. PATENT DOCUMENTS

| | | | |
|---|---|---|---|
| 2,339,240 | 1/1944 | Clayton . | |
| 3,196,815 | 7/1965 | Von Hagen . | |
| 3,404,646 | 10/1968 | Ormeaux et al. | 112/320 |
| 3,472,187 | 10/1969 | Kaplan et al. | 112/320 X |
| 3,570,426 | 3/1971 | Kunes . | |
| 3,570,427 | 8/1970 | Wenz | 112/320 |
| 3,614,934 | 10/1971 | Wenz et al. . | |
| 3,808,994 | 5/1974 | Kuhn . | |
| 3,828,704 | 8/1974 | Von Hagen et al. . | |
| 3,935,826 | 2/1976 | Nicolay et al. | 112/320 |

FOREIGN PATENT DOCUMENTS

| | | | |
|---|---|---|---|
| 952494 | 3/1964 | United Kingdom | 112/309 |

*Primary Examiner*—Werner H. Schroeder

*Assistant Examiner*—Andrew M. Falik

*Attorney, Agent, or Firm*—Edward P. Schmidt; Robert E. Smith; Edward L. Bell

[57] ABSTRACT

A sewing machine utilizing an intermittent upper feeding foot to feed work material in any direction. The upper feeding foot is carried internally of and swivels within a presser tube supporting on the end thereof a presser foot. Means are provided to alternate force on the presser foot during needle penetration and withdrawal, and on the feeding foot during feeding of a work material. During the period when force is applied to the presser foot, the upper feeding foot may be positioned by driving devices to an initial position, and may be driven to a final position after the force has alternated to the feeding foot. The driving devices may be responsive to information retained in intelligence record carriers in order to achieve the initial position and the final position. One driving device is connected by suitble linkage to a Y slide movable in a "Y" direction and connected to the end of the rod opposite the feeding foot. A second driving device is connected by suitable linkage to a X slide movable in a "X" direction, also connected to the end of the rod opposite the feeding foot and carried by the Y slide in a fashion to limit motion thereby to the "X" direction.

6 Claims, 5 Drawing Figures

SEWING MACHINE WITH UNIVERSAL UPPER FEED

BACKGROUND OF THE INVENTION

This invention pertains to sewing machines, more particularly, to a sewing machine having the capability for upper feed of work material.

There are many examples in the prior art of sewing machines having the capability of feeding work material from the upper surface thereof. Such a sewing machine is shown in the recent U.S. Pat. No. 3,935,826, issued on Feb. 3, 1976 to Nicolay et al. In that patent, there is disclosed a sewing machine having alternating hold down foot and feeding foot, which feeding foot is moved while pressed against a work material in order to effect movement thereof.

There is also the U.S. Pat. Nos. 3,808,994 and 3,614,934 which disclose sewing machines with upper feed having presser feet and feeding feet supported on members substantially coaxial. In the above prior art, and any other prior art of which we are aware, feeding may only take place in either direction along a line. Ideally, what is required is a sewing machine with a universal upper feed having the capability to feed in any direction, which capability could be utilized with intelligence record carriers to create patterns of unusual size and intricacy. Further, such an arrangement would require no lower feed and would permit the use of a bed of a very small cross section to simplify stitching operations upon a sleeve or cuff.

SUMMARY OF THE INVENTION

Such an improved sewing machine is found in the device wherein the upper feeding foot is carried on the end of a rod supported internally of and swivelled within a presser tube, which presser tube supports on the end thereof a presser foot. The upper end of the feeding rod opposite the feeding foot carries a two level guidepiece, the lower level of which receives a Y slide for swivelling the feeding rod in the Y direction, and the upper level of which receives an X slide for swivelling the feeding rod in the X direction. The X slide moves in the back and forth direction with the Y slide and is supported by the Y slide for independent motion in the X direction. The slides themselves are connected by levers and linkages to driving devices which may be implemented by an X linear motor and a Y linear motor. Pressure is applied alternately to the feeding foot and to the presser foot by a ternary link, which link is actuated by a long link connected to a fork spanning a constant breadth cam carried by the arm shaft. A pulley is positioned on the horizontal arm shaft adjacent the constant breadth cam and, is connected by a belt to a second pulley which carries a crank for urging the needle bar in endwise reciprocation. The belt also drives a third pulley connected to a counterbalance which actuates a sewing machine takeup. The entire assembly is supported in a frame which includes a drive motor and the electronics for actuating the X and Y linear motors. Within a cylinder bed extension, there is supported a rotating hook driven by a miter gear connection to the sewing machine motor.

DESCRIPTION OF THE DRAWINGS

The novel features which are considered as characteristic for the invention are set forth in particular in the appended claims. The invention itself, however, both as to its construction and its method of operation, together with additional objects and advantages thereof will be best understood from the following description of a specific embodiment when read in connection with the accompanying drawings in which:

Referring to FIG. 1 there is shown the sewing machine 10 having a standard portion 12 supported on the rear thereof by rear bracket 14 and extending forwardly in a bed portion 16 which is supported by a front rail 18. A cylinder bed 20 is formed as part of and extends from the bed portion 16 substantially parallel to the rear bracket 14. At the terminus of the cylinder bed 20 there is supported a bed slide 22 and a throat plate 24.

Figure 1:
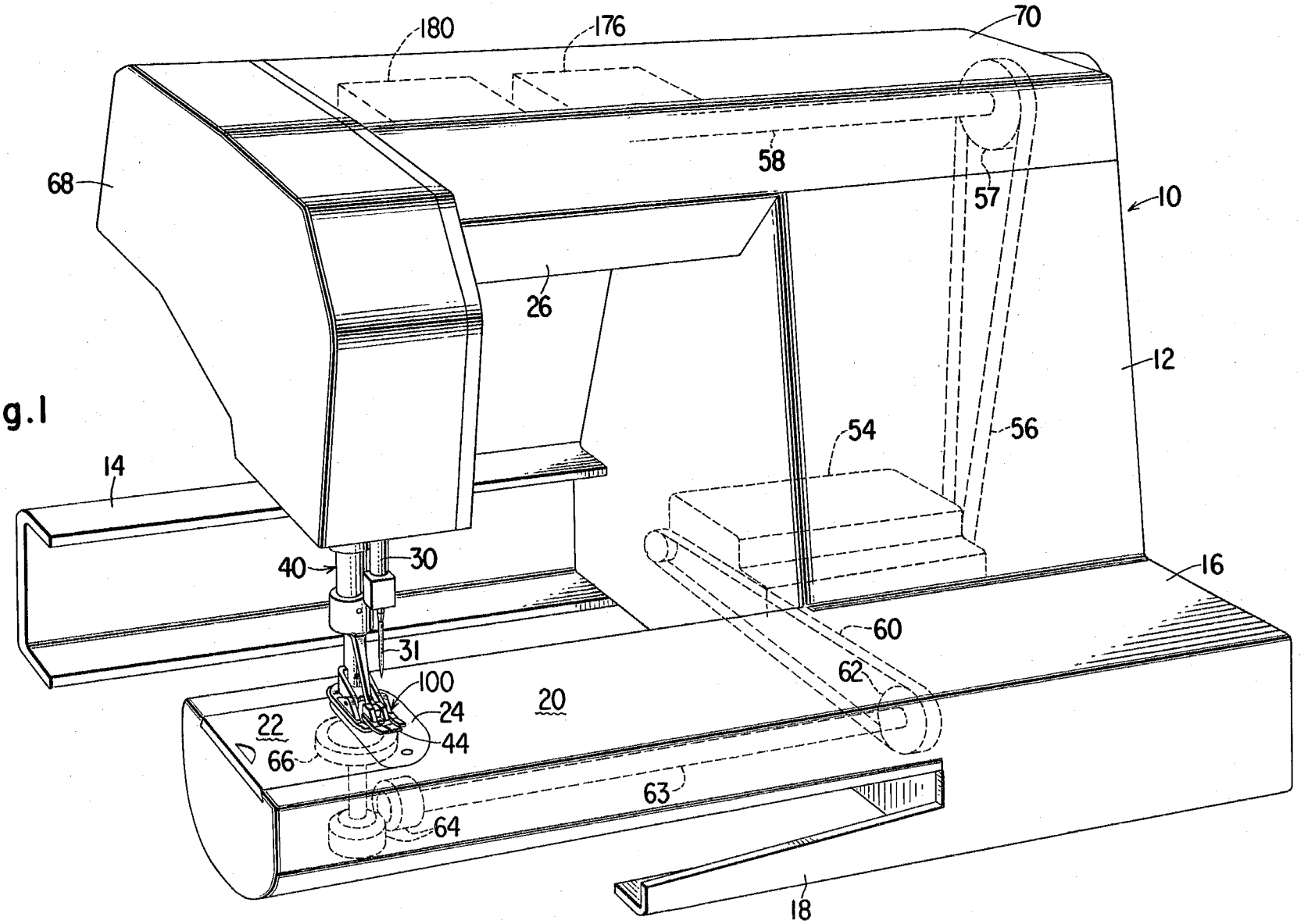
FIG. 1 is a perspective view of the sewing machine in which the invention may be incorporated.

The standard portion 12 rises upwardly and supports a horizontally extending arm 26 in a direction substantially parallel to the cylinder bed 20 and rear bracket 14. A head end 28 (see FIG. 4) is supported at the terminus of the arm 26, the head end extending forwardly to have a portion thereof overhang the cylinder bed 20. Supported in the head end 28 for endwise reciprocation and possible lateral oscillation, is a needle bar 30 supporting at the end thereof a sewing needle 31. Also supported in the head end 28 is a presser tube-feeding rod combination 40 which will be more fully explained below.

There is shown in phantom supported in the standard 12 a main drive motor 54 connected, by way of belt 56 and pulley 57, to horizontal arm shaft 58. A second belt 60 connects the main drive motor 54 to a pulley 62 supported on a rotating hook drive shaft 63. The rotating hook drive shaft 63 is connected by way of miter gears 64 to the rotating looptaker 66 supported in the end of the cylinder bed 20 beneath the throat plate 24. As is well known in the sewing machine art, the needle bar 30 undergoes endwise reciprocation (and may also undergo lateral oscillation) to bring the sewing needle 31 to a depressed position extending through an opening (not shown) in the throat plate 24 for cooperation with the rotating looptaker 66 and the formation of stitches. The sewing machine 10 as shown in FIG. 1 is fashioned with a front cover plate 68 and a top cover plate 70, both of which may be removed to expose the inner workings of the machine.

Figure 2:
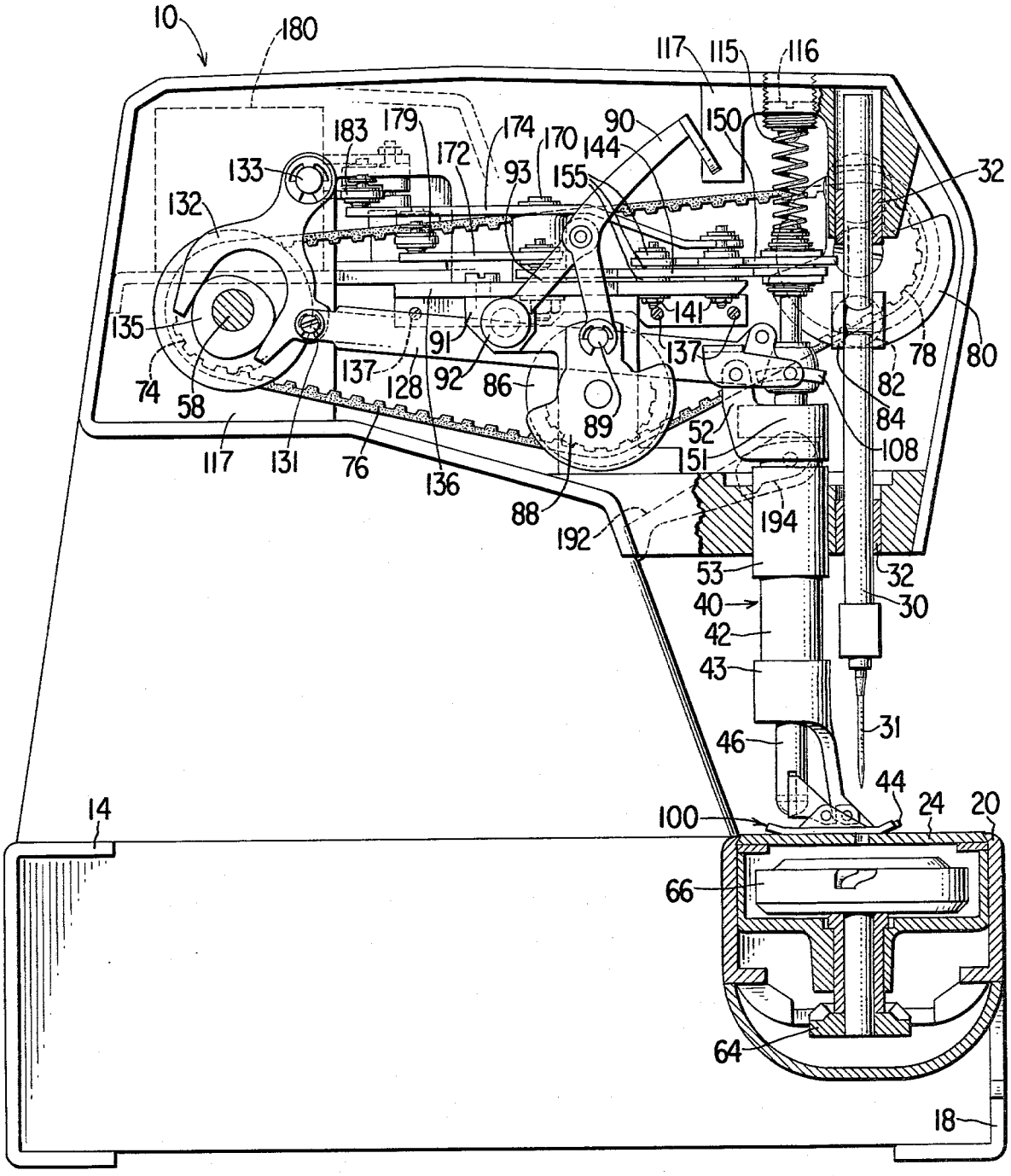
FIG. 2 is a front end elevation of the sewing machine with the cover plates removed and partially in section to show internal details of construction.

Referring now to FIG. 2 there is shown a head end elevation of the sewing machine shown in FIG. 1 with the front cover plate 68 thereof removed. Portions of the head end 28 and cylinder bed 20 were sectioned in order that greater detail might be shown. In FIG. 2 there is visible the horizontal arm shaft 58 to which there is affixed a toothed pulley 74 (see also FIG. 3). A belt 76 of the timing variety having teeth for meshing with the teeth on the pulley 74 encircles the pulley and further encircles a second pulley 78 located adjacent the needle bar 30. The second pulley 78 is formed integrally with or connected to a crank 80, which crank is connected by way of connecting link 82 to a driving stud 84 affixed to the needle bar 30 (see also FIG. 4). The belt 76 passes around a third pulley 86, which third pulley is affixed to a second crank 88 which is connected by a stud 89 to a takeup lever 90 pivoted on a link 93, which link oscillates on pivot 92 which is carried by angle bracket 91. Thus, the belt 76 is driven by the horizontal arm shaft 58 to urge the needle bar 30 in endwise reciprocation and to actuate the takeup lever 90 for thread manipulating motion in cooperation with the sewing needle 31 and the looptaker 66.

It is evident from an inspection of FIG. 2 that the needle bar 30 reciprocates within bearings 32 carried within the head of the sewing machine. It will be appreciated by those of ordinary skill in the art that the needle bar 30 might be supported in a needle bar gate, which gate might be urged by an actuator into selected lateral motion in the formation of ornamental patterns. For the sake of simplicity in the present application, however, the added complexity of such an arrangement has been avoided.

Figure 4:
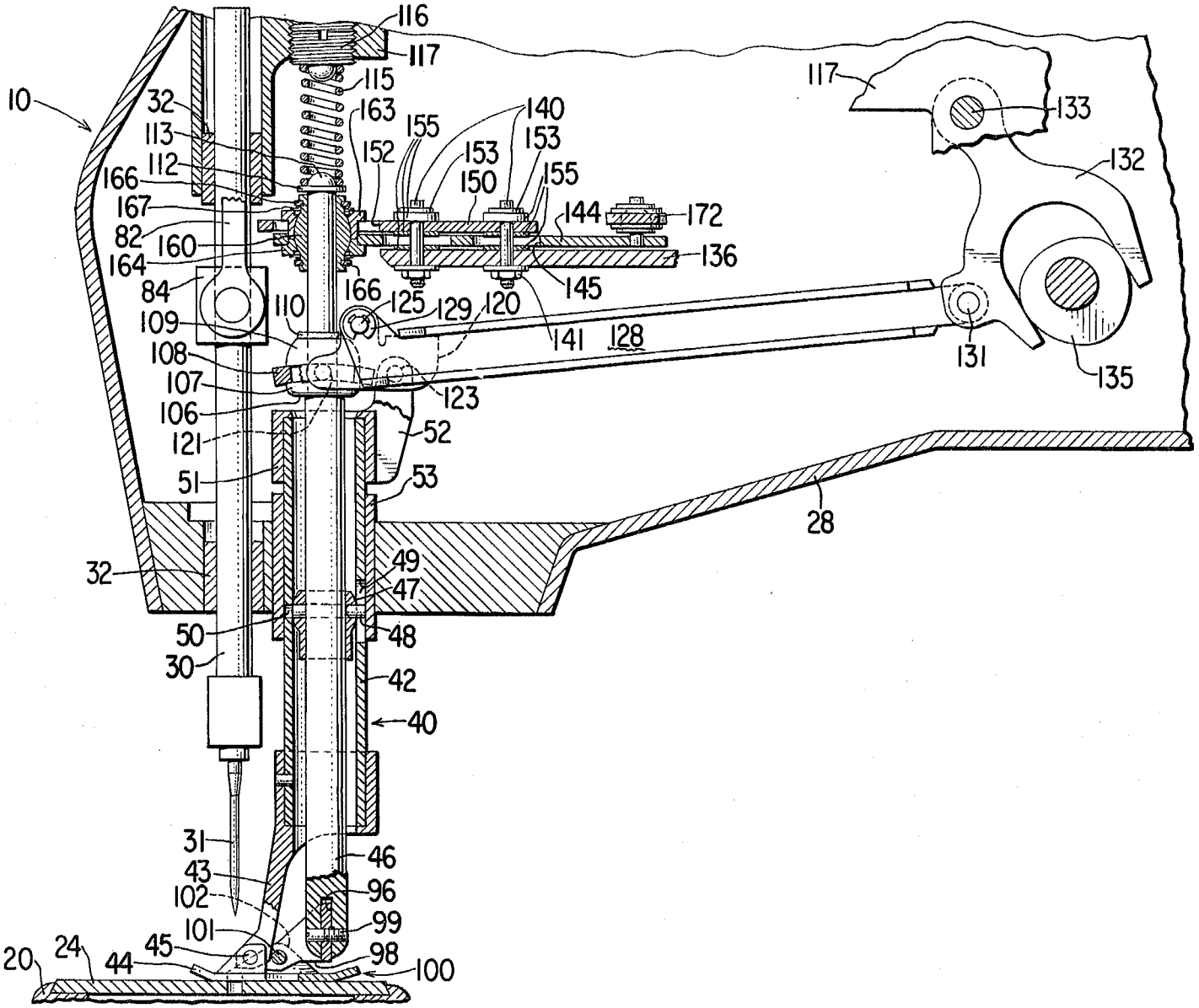
FIG. 4 is a view taken substantially along line 4—4 of FIG. 3 and showing the internal construction of the presser tube and feeding rod; and, FIG. 5 is a perspective view of the presser tube and feeding rod showing in more detail the connections thereto and the action of a presser lifter thereupon.

Referring now to FIG. 4 there is shown the presser tube-feeding rod assembly 40 having as an outer portion thereto a presser tube 42 to the end of which there is affixed a presser foot 43. The sole plate 44 of the presser foot 43 is free to swivel in a fore to aft direction on the pivot pin 45. A feeding rod 46 is situated internally of the presser tube 42 and extends from both ends thereof. The feeding rod 46 extends through the center of a ball 47 to which it is connected by pin 48, the ball being of such a size to fit snugly within the presser tube 42 and swivel freely therein. The pin 48 extends through the ball 47 and feeding rod 46, the pin 48 extending beyond the ball on one side thereof into an axially extending slot 49 through one side of the presser tube 42. The feeding rod 46 and ball 47 may thus be restricted to limited axial movement with respect to the presser tube 42. A hole 50 in the presser tube 42 opposite the slot 49 is provided for disassembly purposes in order to permit the pin 48 to be driven out of the ball 47. This portion of the assembly is completed by a presser cap 51 on the end of the presser tube 42 opposite the presser foot 43, the presser cap having a laterally extending arm 52 whose purpose will be explained below. A sleeve bearing 53 is captured on the presser tube 42 between the presser cap 51 and presser foot 43, there being provided means (not shown) for restricting motion of the sleeve bearing in the head end 28 of the sewing machine 10 so that the presser tube may partake of limited vertical motion within the bearing.

The feeding rod 46 is fashioned at the bottom end thereof with a vertical transverse slot 96. An upper bracket 98 of a feeding foot 100 is carried in the transverse slot 96 and is pivotable therein on a pin screw 99 spanning the slot and threadedly connected to the feeding rod 46. The upper bracket 98 is fashioned with forwardly extending ears connected by swivel pins 101 to lugs 102 extending upwardly from the feeding foot sole plate 104 (see also FIG. 5). Thus, the feeding foot 100 is supported on the end of the feeding rod 46 freely pivotable in a fore and aft direction as well as in a lateral direction.

The upper end of the feeding rod 46 is stepped at 106 to create a reduced cross section thereabove. A washer 107, preferably made of a synthetic resin having low friction characteristics, is seated on the step 106 and has an upper surface thereof of spherical form having a radius extending from the upper surface to the center of the ball 47 affixed to the feeding rod 46. A metal ring 108 having top and bottom surfaces of spherical shape complementary to the spherical upper surface of the washer 107 sits above the washer, and is trapped between it and a crown 109, also preferably made of synthetic resin having low friction characteristics. A retaining ring 110 fits into a groove (not shown) in the feeding rod 46 and retains the crown 109, metal ring 108 and washer 107 in close proximity to each other and to the step 106 in the rod. Thus, the metal ring 108 is free to move with respect to the feeding rod 46, within a specific radius of the ball 47, as retained by the washer 107 and crown 109.

A second retaining ring 112 is formed on the top of the feeding rod 46 just beneath the rounded end 113 thereof. A compression spring 115 extends between the second retaining ring 112 and an adjustment screw 116 supported in the frame 117 of the sewing machine 10 directly above the rounded end 113 of the feeding rod 46. The compression spring 115 is the source of the force to be applied alternately to the presser foot 43 and the feeding foot 100.

Figure 5:
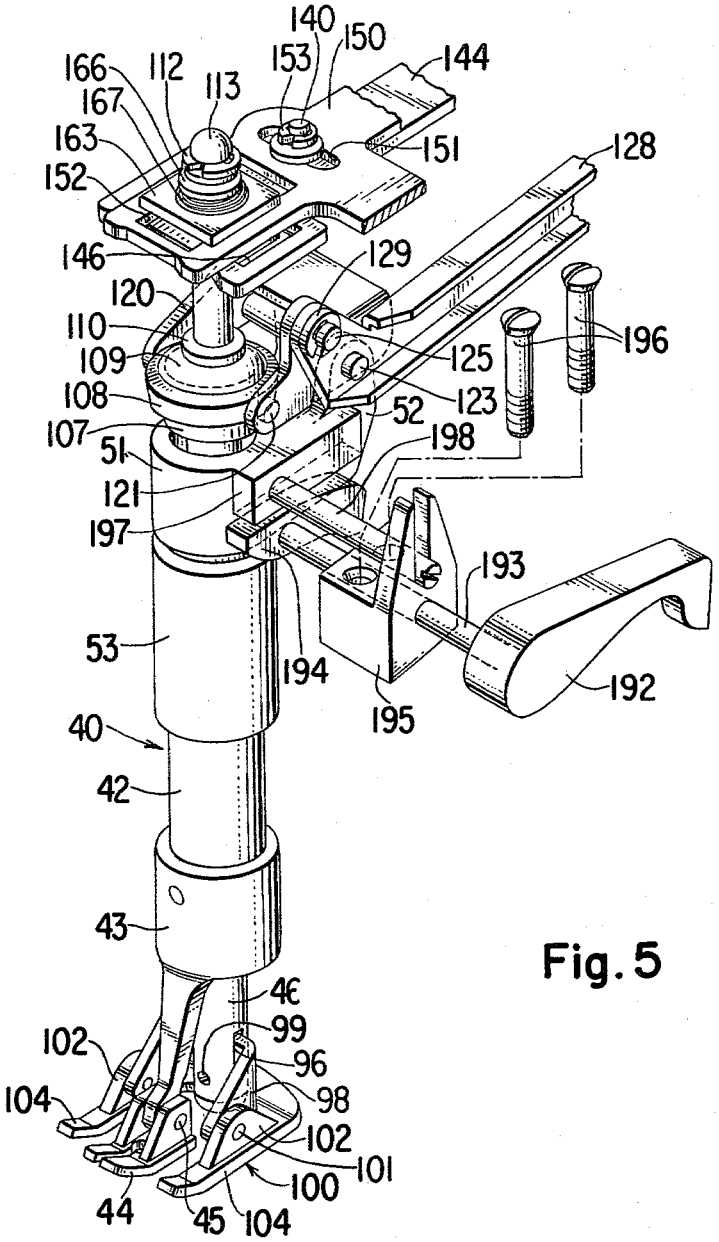

There is shown in FIGS. 4 and 5 a sheet metal ternary link 120 having one swivel connection to the metal ring 108 by means of pins 121 on both sides thereof. A second connection of the ternary link 120 is made by means of pin 123 to the laterally extending arms 52 of the presser cap 51. The pins 121 and 123 are located substantially in the same horizontal plane. The third connection of the ternary link 120 is made by the pin 125 located above and substantially between the pins 121 and 123. The pin 125 is connected by a retaining ring 129 to one end of a long link 128. The opposite end of the long link 128 is connected by pin 131 to a fork 132 pivoted on the sewing machine frame 117 on pivot pin 133. The fork 132 spans a constant breadth cam 135 affixed to the horizontal arm shaft 58 for rotation therewith. Thus, when the constant breadth cam 135 throws the fork 132 and long link 128 in the direction of the needle bar 30, the force from the compression spring 115 passes directly through the feeding rod 46 to the feeding foot 100 since the pivot 125 of the ternary link 120 is located over the pivot 121 thereof. Simultaneously therewith, the pivot 123 of the ternary link 120 is elevated, drawing the laterally extending arms 52 and presser cap 51 to an elevated position together with the presser tube 42 and presser foot 43 attached thereto. Upon continued rotation of the horizontal arm shaft 58, the constant breadth cam 135 throws the fork 132 and long link 128 in a direction away from the needle bar 30 to a position where the pivot 125 overhangs the pivot 123 and the pivot 121 is elevated. Under these conditions, the force from the compression spring 115 is fed through the pivot 121 to the pivot 123, thereby causing the presser foot 43 to be lowered into engagement with the work material and the feeding foot 100 to be elevated out of engagement therewith. Thus, force is alternately brought to bear on the presser foot 43 and the feeding foot 100. Relative motion between the feeding rod 46 supporting the feeding foot 100, and the presser tube 42 supporting the presser foot 43, is accommodated by the axially extending slot 49 through one side of the presser tube, which slot receives the pin 48 connecting the ball 47 and feeding rod 46.

Figure 3:
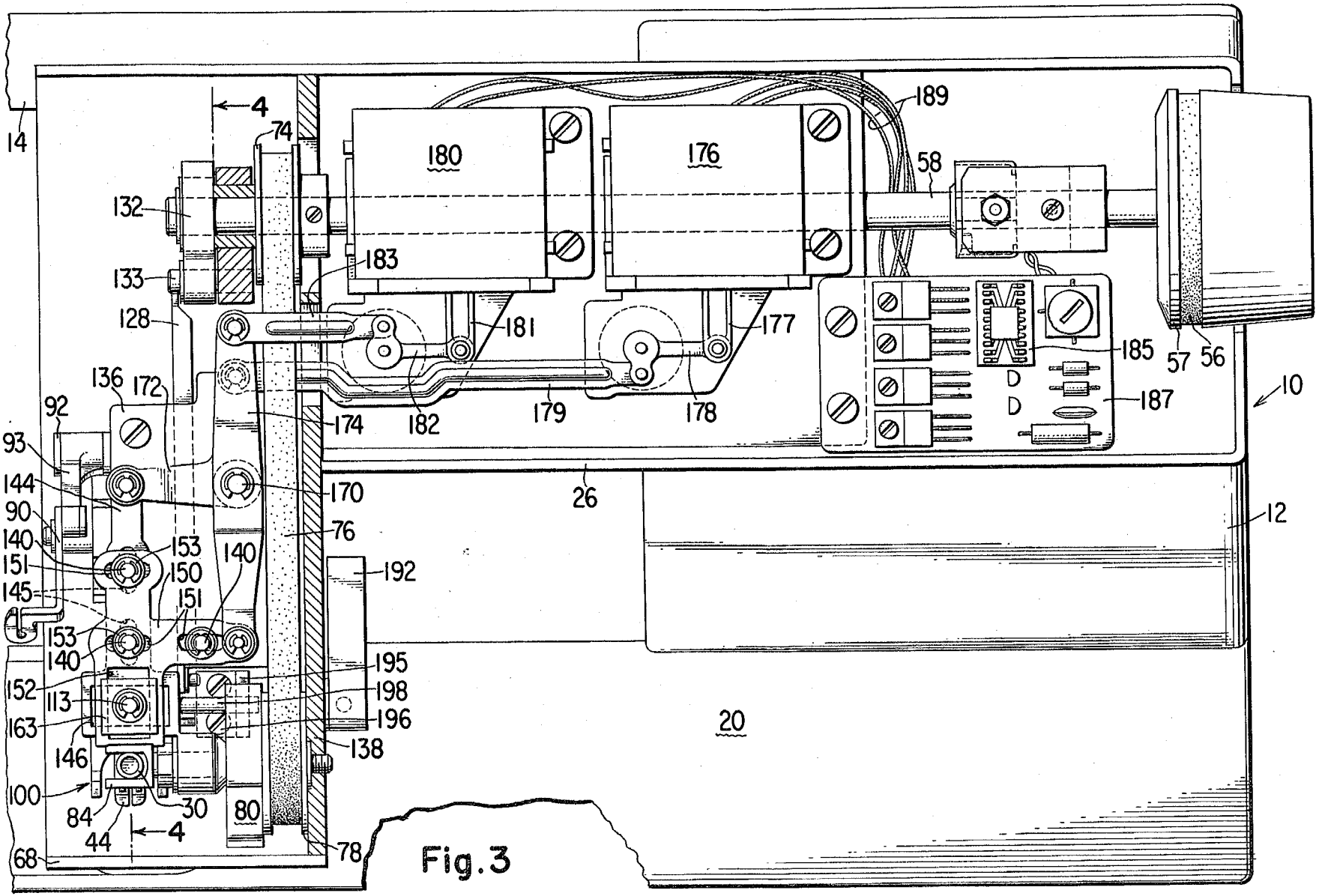
FIG. 3 is a top plan of the sewing machine shown in FIG. 1 with the front cover and top cover removed in order to show details of construction.

Referring now to FIGS. 2 and 3 there is visible an angle bracket 136 which is affixed to the rib 138 of the sewing machine 10 by screws 137. Three upstanding pins 140 are fastened to the top surface of the angle bracket 136 in a pattern to form a right angle. A Y slide 144 is arranged on the upper surface of the angle bracket 136 with two of the upstanding pins 140 engaged in slots 145 in the slide to restrict its motion to the Y direction. An X slide 150 is arranged on top of the Y slide 144 and has all three upstanding pins 140 captured in slots 151 extending in the X direction, or in the direction normal to that of slots 145 in the Y slide 144. The slides 144, 150 are retained on the upstanding pins 140 by retaining rings 153. Low friction synthetic resin washers 155 are positioned on the upstanding pins 140 between the angle bracket 136 and the Y slide 144, between the Y slide 144 and the X slide 150, and between the X slide 150 and the retaining rings 153 (see FIG. 2). The end of the Y slide 144 is fashioned with an opening 146 rectilinear in shape and having a longer dimension in the X direction than in the Y direction. The X slide 150 has a similar rectilinear shaped opening 152 having, however, the longer dimension in the Y direction than in the X direction. By reference to FIG. 4 it can be seen that a steel ball 160 extends through the openings 146 and 152, the steel ball having a central aperture 161 for receiving the upper end of the feeding rod 46. The steel ball 160 is retained in position by a two piece guidepiece 163, 164, the inner sides of which form a socket for the ball, and the outer sides of which are grooved in two levels to receive in the lower level the opening 146 in the Y slide 144 and to receive in the upper level the opening 152 in the X slide 150. The two piece guidepiece 163, 164 are retained in position by retaining rings 166 affixed to the steel ball 160 and springs 167 between the retaining rings and the slides which remove the play therefrom. Thus, the steel ball 160 is supported by the Y slide 144 and the X slide 150 on the upper end of the feeding rod 46.

Referring now more particularly to FIG. 3, it may be disclosed how the Y slide 144 and the X slide 150 are actuated in order to cause pivotable motion of the feeding rod 46 about the ball 47 internal of the presser tube 42 in order to effect shifting of the work material by the feeding foot 100. A pintle 170 is supported by the bracket 136, the pintle supporting for rotation thereabout bell crank 172 and lever 174. The bell crank 172 is connected to the Y slide 144 at the end thereof opposite the opening 146. Thus, oscillation of the bell crank 172 about the pintle 170 will cause to and fro motion of the Y slide 144 in the Y direction. Similarly, the lever 174 is connected to an extremity of the X slide 150 in a fashion to cause to and fro motion of the X slide upon oscillation of the lever. There are mounted within the horizontally extending arm 26 of the sewing machine 10 a Y linear motor 176 and an X linear motor 180. The shaft 177 of the Y linear motor 176 is connected to one arm of bell crank 178, the other arm of which is connected to link 179 which drives the bell crank 172 connected to the Y slide 144. Thus, endwise motion of the shaft 177 of the Y linear motor 176 will effect actuation of the Y slide 144. Similarly, the X linear motor 180 actuates the shaft 181 thereof which causes oscillation of bell crank 182, the oscillation of which is transferred by the link 183 to the lever 174. Thus, endwise motion of the shaft 181 of X linear motor 180 results in lateral positioning of the X slide 150.

Thus, actuation of the Y linear motor 176 and the X linear motor 180 will operate to swivel the feeding rod 46 about the ball 47 in order to manipulate the feeding foot 100 into a new position. While the sewing needle 31 is in the work material and cooperating with the rotating looptaker 66 in the formation of a stitch, the constant breadth cam 135 is in a position to urge the presser foot 43 against the work material in order to provide thrust thereto against the force and drag of the sewing needle. The feeding foot 100 at that time is in an elevated position and may be positioned by the Y linear motor 176 and X linear motor 180 to a starting position preparatory for feeding the work material a selected distance in a selected direction. After the sewing needle 31 has been removed from the work material, the constant breadth cam 135 moves into a position to urge the feeding foot 100 against the work material while removing the presser foot 43 from contact therewith. With the feeding foot 100 in contact with the work material, the Y linear motor 176 and the X linear motor 180 may be actuated to new positions in order to achieve the final position of the feeding foot 100 and the work material prior to the next stitch. It will be apparent to those skilled in the art that the work material may be fed in any direction on the cylinder bed. Information for direction of the Y linear motor 176 and X linear motor 180 may be stored in a large scale integration (LSI) integrated circuit 185 supported on a printed circuit board 187. The printed circuit board 187 also supports components of servo amplifiers for actuating the linear motors, the output of the amplifiers being transferred to linear motors by way of leads 189. For further particulars on the linear motors, and circuitry for actuation thereof the reader is referred to the U.S. Pat. No. 3,984,745 issued on Oct. 5, 1976 to Minalga, which patent was assigned to the assignee of the instant application and which patent is hereby incorporated by reference herein.

Referring now to FIG. 5, there are disclosed details of the presser lifter arrangement for the sewing machine 10. A presser lifter lever 192 is connected by way of shaft 193 to a cam 194. The shaft 193 is journalled in a guide block 195 which is affixed to the sewing machine frame by screws 196. The presser cap 51 is fashioned with a shoulder 197 which the cam 194 operates against to raise the presser tubefeeding rod assembly 40 when the presser lifter lever 192 is rotated by a sewing machine operator. A guide pin 198 carried by the presser cap 51 extends into guide slots 199 formed as part of the guide block 195 in order to maintain alignment of the feet 43, 100 upon returning to a lowered position.

There has been disclosed herein an upper feed system for a sewing machine which may feed work material in any direction in the plane of the bed thereof. A feeding rod arrangement is supported coaxial with a presser bar, and means are provided to alternate pressure on the presser bar and feeding rod. Also means are provided to swivel the end of the feeding rod opposite the feeding foot so as to manipulate the feeding foot a selected distance in a selected direction. There is also disclosed means for manipulating the end of the feeding rod a desired magnitude in a desired direction. This particular construction enables the utilization of an extremely narrow cylinder bed within which there need only be supported a looptaker.

I claim:

1. In a sewing machine having a frame, a needle bar supported for endwise reciprocation within said frame, a drive means for selectively imparting endwise reciprocation to said needle bar, an upper feeding system comprising: a presser strut supported by said frame for endwise motion, a feeding rod, a presser foot affixed to one end of said presser strut, a feeding foot affixed to one end of said feeding rod, means for supporting said feeding rod to enable motion of said feeding foot in any direction, means for alternately pressing said feeding foot and said presser foot against a work material, and means connected to the other end of said feeding rod from said feeding foot for shifting said feeding foot to any selected position within its range of motion.

2. An upper feeding system as claimed in claim 1 wherein said presser strut is implemented by a presser tube, and wherein said feeding rod is supported internally of said presser tube extending from both ends thereof.

3. An upper feeding system as claimed in claim 2 wherein said means for supporting said feeding rod further comprises a ball slidably carried internally of said presser tube, said ball having a central aperture for receiving said feeding rod; a pin extending through said ball and said feeding rod, whereby said feeding rod and said ball may oscillate on and within said presser tube.

4. An upper feeding system as claimed in claim 2 wherein said shifting means further comprises: a pair of slides shiftably supported by said sewing machine frame, said slides being connected to said feeding rod, a first of said slides being arranged to shift in a lateral direction, the second of said slides being arranged to shift in a longitudinal direction, the first slide being carried by said second slide, and means for urging said slides to shift in selected directions.

5. An upper feeding system as claimed in claim 2 wherein said means for supporting said feeding rod further comprises a ball slidably carried internally of said presser tube, said ball having a central aperture for receiving said feeding rod; a pin extending through said ball and said feeding rod so that said feeding rod and said ball may oscillate on and within said presser tube; and wherein said shifting means further comprises machine frame, said slides being connected to said feeding rod, a first of said slides being arranged to shift in a lateral direction, a second of said slides being arranged to shift in a longitudinal direction, a first slide being carried by said second slide, and means for urging said slides to shift in selected directions.

6. An upper feeding system as claimed in claim 5 wherein said pin extends beyond one side of said ball, and wherein said presser tube is formed with an axially aligned slot receiving said pin extending beyond said ball, whereby relative motion between said feeding rod and said presser tube during operation of said alternately pressing means may be accommodated.

* * * * *